United States Patent [19]

Santiago

[11] Patent Number: 4,887,651

[45] Date of Patent: Dec. 19, 1989

[54] METHOD FOR PRESSURIZING LIQUID

[75] Inventor: Moises Santiago, Cooper City, Fla.

[73] Assignee: Union Carbide Corporation, Danbury, Conn.

[21] Appl. No.: 258,703

[22] Filed: Oct. 17, 1988

Related U.S. Application Data

[62] Division of Ser. No. 49,555, May 14, 1987, abandoned.

[51] Int. Cl.[4] ..... B67C 1/04

[52] U.S. Cl. ..... 141/1; 141/4; 141/11; 222/1; 222/399; 426/477

[58] Field of Search ..... 141/1, 2, 4, 5, 9, 11, 141/17, 18, 98; 426/477; 222/1, 630, 394, 399; 261/DIG. 7

[56] References Cited

U.S. PATENT DOCUMENTS

| | | | |
|---|---|---|---|
| 3,592,367 | 7/1971 | Landis et al. | 222/394 |
| 3,790,039 | 2/1974 | Zucconi | 222/394 |
| 3,986,535 | 10/1976 | Meckstroth | 141/113 |
| 4,057,510 | 11/1977 | Crouch et al. | 252/372 |
| 4,475,576 | 10/1984 | Simon | 141/98 |
| 4,481,986 | 11/1984 | Meyers | 141/4 |
| 4,512,377 | 4/1985 | Greer | 141/11 |
| 4,560,089 | 12/1985 | McMillen et al. | 222/399 X |
| 4,595,121 | 6/1986 | Schultz | 222/1 |
| 4,671,329 | 6/1987 | Kovacevich, Jr. | 141/5 |
| 4,706,847 | 11/1987 | Sankey et al. | 222/1 |

OTHER PUBLICATIONS

Specialty Gases, Linde Union Carbide, Section 2, pp. 1–31, (1985).

*Primary Examiner*—Ernest G. Cusick
*Attorney, Agent, or Firm*—Stanley Ktorides

[57] ABSTRACT

A method for pressurizing an aqueous liquid and delivering the liquid into a serving vessel while undergoing a pressure reduction wherein a large but not excessive head is formed on the liquid in the vessel by use of pressurizing gas consisting essentially of from 32 to 70 volume percent carbon dioxide and the balance being one or more gases having a solubility in water less than carbon dioxide.

13 Claims, 1 Drawing Sheet

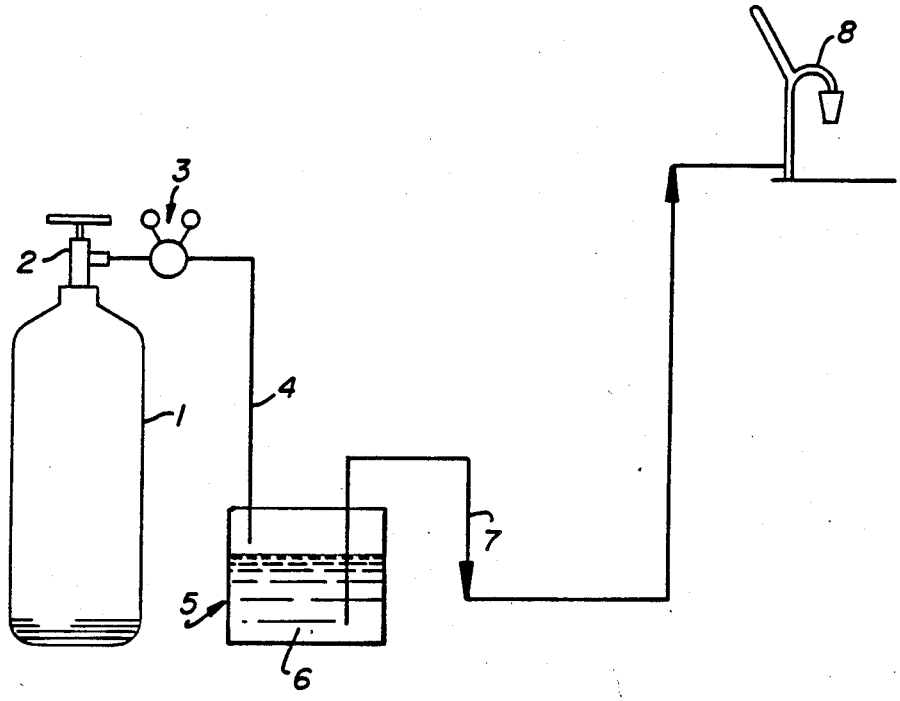
8
3
2
4
1
7
5
6

METHOD FOR PRESSURIZING LIQUID

This is a division of Ser. No. 049,555, filed 5/14/89, now abandoned.

TECHNICAL FIELD

This invention relates generally to the pressurization of a liquid with a gas and more particularly to the pressurization of a carbonated liquid, such as beer, to facilitate the passage of the liquid out of a container.

BACKGROUND ART

Liquid in a container is often pressurized by contact with a higher pressure gas in order to facilitate the passage of the liquid out of the container. Generally, the gas employed is carbon dioxide. This is especially the case when the liquid is a carbonated liquid such as beer. For example, when beer is contained in a keg, higher pressure carbon dioxide is passed into the keg and serves to increase the flowrate of the beer out from the keg over the flowrate which would otherwise occur. This enhances the speed and efficiency of the pouring operation.

A problem with the conventional pressurization and pouring method is that considerable froth or foam is generated during the pouring, reguiring a time loss to await dissolution of the foam and/or the waste of some liquid if the foam must be discarded. When the liquid is beer, a certain amount of foam or head is desired as being aesthetically pleasing. However a large head on a glass or mug of beer is wasteful and counterproductive. The problem of excessive foaming of keg beer is especially troublesome during peak demand periods when time cannot be spent to reduce beer loss due to foam.

Accordingly it is an object of this invention to provide a method and tapping agent to enable the pressurized passage of a liquid out from a container with reduced foam generation.

It is a further object of this invention to provide a gas mixture and method to pressurize a beer keg to enable enhanced flow of beer out of the keg with the generation of an aesthetically pleasing but not excessive head.

SUMMARY OF THE INVENTION

The above and other objects of this invention which will become apparent to those skilled in the art upon a reading of this disclosure are attained by the present invention one aspect of which is:

A gas mixture consisting essentially of from 32 to 70 percent carbon dioxide, balance one or more gases having a solubility in water less than carbon dioxide.

Another aspect of the invention is:

A method for pressurizing a liquid comprising contacting the liquid with a gas mixture which is at a pressure exceeding that of the liquid, said gas mixture comprising from 10 to 70 percent carbon dioxide, balance one or more gases having a solubility in said liquid less than carbon dioxide.

As used herein the term "carbonated liquid" means a liquid having carbon dioxide dissolved therein.

As used herein the term "solubility" means the extent to which a gaseous species mixes with a liquid to produce a homoqeneous system.

As used herein the term "head" means the foam rising on an effervescing liquid.

BRIEF DESCRIPTION OF THE DRAWINGS

The sole FIGURE is a schematic representation of one embodiment of a system capable of carrying out the method of the invention.

DETAILED DESCRIPTION

The invention in its broadest embodiment comprises a gas mixture of from 10 to 70 percent carbon dioxide with the balance being one or more gases having a solubility in water less the carbon dioxide. The percentage terms are in volume percent.

Preferably, the gas mixture contains from 32 to 70 percent carbon dioxide, more preferably from 32 to 48 percent carbon dioxide, most preferably from 32 to 40 percent carbon dioxide. A carbon dioxide concentration in excess of 70 percent will generally result in disadvantageous high liquid foaming while a carbon dioxide concentration less than 32 percent will qenerally not enable the formation of a desirably sufficient head, and a carbon dioxide concentration less than 10 percent will generally result in virtually no foam due to general insolubility of the gas mixture.

The balance of the gas mixture is composed of one or more gases whose solubility in water is less than that of carbon dioxide. Examples of such gases include nitrogen and argon. Any suitable gas may be employed as long as it is compatible with, and preferably inert to, the liquid. Furthermore, if the liquid is intended for consumption, such as is beer or a carbonated beverage, the gas balance should be such as to not render the liquid unsuitable for consumption. Preferably, the balance of the gas mixture is made up totally of nitrogen.

The gas mixture may be contained in any suitable vessel and preferably is contained in a cylinder which can be conveniently transported to and connected with the liquid container through appropriate conduit means. Alternatively, the gas mixture could be contained in a stationary tank which can be hooked up to the liquid container through appropriate conduit means. In addition the gas mixture could be made up as it is being used from two or more separate cylinders or tanks so that the gases making up the gas mixture are mixed, for example, just outside the liquid container.

The gas mixture of this invention is delivered in contact with liquid at a pressure which exceeds that of the liquid prior to the contact. Generally, the pressure of the delivered gas mixture will be within the range of from 2 to 25 psig preferably within the range of from 5 to 15 psig.

The gas mixture of this invention may be used to pressurize any suitable liquid. In addition to beer and carbonated beverages, other suitable liquids include aqueous based liquids and liquids which undergo commercial fermentation. Particularly preferred liquids ar carbonated liquids such as beer, flavored soda, and carbonated water.

The FIGURE represents one system employing the gas mixture and method of the invention to tap beer out of a keg such as might be used in a commercial retail setting.

Referring now to the FIGURE, the gas mixture of this invention is contained in gas storage cylinder 1. The gas mixture is passed out of cylinder 1 through valve 2 and pressure control regulation 3 and is delivered throuqh conduit 4 to beer keg 5 at a pressure exceeding the pressure within the beer keg. Beer 6 within keg 5 is caused to flow out of keg 5 through conduit 7 to tap 8 through which it is poured into glasses with the generation of sufficient but not excessive head. In a commercial retail settling such as is depicted in the Figure, it is not unusual to have the gas cylinder and beer keg in a separate storage room separated from the taproom by a wall.

The followinq examples serve to further illustrate the invention. They are provided for illustrative purposes and are not intended to be limiting.

EXAMPLE 1

A cylinder of gas containing 65.2 cubic 25 feet of a gas mixture at 1724 pounds per square inch gauge (psig) and 70° F. was connected by conduit means to be in flow communication with a keg containing 16 gallons of beer at atmospheric pressure. The gas mixture was comprised of 35 percent carbon dioxide and 65 percent nitrogen. The gas mixture was passed out of the cylinder through appropriate valve and regulator means and was delivered to the keg and into contact with the beer at a pressure of 10 psig. Beer was withdrawn out of the keg through a tapspout and poured into a glass to fill the glass. The head of the beer in the glass was well formed, had good foam consistency, was of a desirable size, and did not overflow the glass.

EXAMPLE 2

A procedure similar to that reported in Example 1 was carried out except that the gas mixture was comprised 25 percent carbon dioxide and 75 percent argon. The gas mixture was delivered to the keg at a pressure of 5 psig and also at a pressure of 25 psig. In both instances the beer head was well formed and did not overflow the glass, although the head dissipated after a short time.

COMPARATIVE EXAMPLE

For comparative purposes the following comparative example is reported.

A procedure similar to that reported in Example 1 was carried out except that the pressurizing gas is 100 percent carbon dioxide, i.e., the heretofore conventionally employed gas for pressurizing beer kegs. The head on the beer in the glass takes up the major portion of the volume of the glass and, in order to pour a full glass of beer without an inordinate wait, much of the head must be discarded.

Without wishing to be held to any theory, the inventor offers the following as one possible explanation for the beneficial results obtained with the invention.

Carbon dioxide is highly soluble in water and in water based liquids such as beer. When a liquid, e.g., beer in a keg, is conventionally pressurized using pure carbon dioxide, much of this carbon dioxide goes into solution with the liquid. Upon exiting the container, the pressure on the liquid is significantly reduced, generally down to atmospheric pressure. This causes much of the gas in solution to come out of solution and in the process form bubbles. Since so much carbon dioxide gas goes into solution, the suddeness of the bubbling combined with the large volume of gas coming out of solution combines to create an exaggerated foaming effect.

With the invention, however, much less of the pressurizing gas goes into solution than would have been the case had pure carbon dioxide been used. Thus, the foaming effect is considerably reduced and much better controlled. The defined amount of carbon dioxide of the invention enables a smooth pressurizing effect and also ensures the formation of some foam which has an aesthetically pleasing affect in the case of beer.

I claim:

1. A method for pressurizing an aqueous liquid in a container and delivering the liquid from the container into a vessel while controlling the foaming effect of the liquid comprising contacting the liquid in the container with a gas mixture which is at a pressure exceeding that of the liquid, said gas mixture consisting essentially of from 32 to 70 volume percent carbon dioxide and the balance being one or more gases having a solubility in water less than carbon dioxide, and passing the liquid from the container into a vessel while reducing the pressure of the liquid and generating foam in a controlled manner.

2. The method of claim 1 wherein the liquid is a carbonated liquid.

3. The method of claim 2 wherein the carbonated liquid is beer.

4. The method of claim 2 wherein the carbonated liquid is flavored soda.

5. The method of claim 2 wherein the carbonated liquid is carbonated water.

6. The method of claim 1 wherein the liquid is contained in a container and the gas mixture is passed from a vessel into the container to contact the liquid.

7. The method of claim 1 wherein the liquid is contained in a container and the gas mixture is made up outside the container and passed inside the container to contact the liquid.

8. The method of claim 1 wherein the carbon dioxide comprises from 32 to 48 percent of the mixture.

9. The method of claim 1 wherein the carbon dioxide comprises from 32 to 40 percent of the mixture.

10. The method of claim 1 wherein nitrogen comprises the balance of the gas mixture.

11. The method of claim 1 wherein argon comprises the balance of the gas mixture.

12. The method of claim 1 wherein the gas mixture is contained within a portable cylinder and passed from the cylinder by conduit means into contact with the liquid.

13. The method of claim 1 wherein the pressure of the liquid is reduced to atmospheric pressure while generating foam in a controlled manner.

* * * * *